US006041918A

United States Patent [19]

Moore

[11] Patent Number: 6,041,918

[45] Date of Patent: Mar. 28, 2000

[54] CURVILINEAR SECTIONED RETAIL PACKAGE FOR FOOD COMPRISING A BISECTED CONTAINER HAVING A SECONDARY UTILITY

[76] Inventor: M. Douglas Moore, P.O. Box 102, Hebron, Ohio 43025

[21] Appl. No.: 08/976,701

[22] Filed: Nov. 24, 1997

[51] Int. Cl.[7] ..... B65D 81/00

[52] U.S. Cl. ..... 206/0.815; 206/457; 220/4.21

[58] Field of Search ..... 206/457, 557, 206/0.8, 0.815, 0.82; 220/4.25, 4.21

[56] References Cited

U.S. PATENT DOCUMENTS

| | | | |
|---|---|---|---|
| 1,388,094 | 8/1921 | Buttigieg | 206/457 X |
| 1,800,990 | 4/1931 | Forrest | 206/457 X |
| 2,745,642 | 5/1956 | Hesmann | 220/4.25 X |
| 2,784,512 | 3/1957 | Goodwin | 220/4.25 X |
| 4,221,293 | 9/1980 | Anthony | 220/4.25 X |
| 5,209,345 | 5/1993 | Haugabook | 206/457 X |
| 5,622,261 | 4/1997 | Mobley et al. | 206/457 |
| 5,638,982 | 6/1997 | Spector | 206/457 X |

*Primary Examiner*—Jacob K. Ackun
*Attorney, Agent, or Firm*—Porter, Wright, Morris & Arthur, LLP

[57] ABSTRACT

A bisectioned package is formed from curvilinear cross-sectioned mating components to provide the shape of a sport ball. The sections are formed from tinplate, aluminum, metal or a polymer can or container material and are readily separable. The container is usefully sized to hold a separately packaged serving of snack food. Graphic representations of features of an athletic ball are provided on the outer surfaces of the mating sections, and optionally the inner surfaces of the mating sections allow features of a playing field, stadium or sports theme to be displayed as a panorama. After the retail package function of the container is exhausted following purchase of the item, the separate mating components of the bisectioned container are useful as bowls for consumption of the packaged food and can be subsequently re-mated to form a separately useful keepsake or container such as a coin bank.

18 Claims, 2 Drawing Sheets

CURVILINEAR SECTIONED RETAIL PACKAGE FOR FOOD COMPRISING A BISECTED CONTAINER HAVING A SECONDARY UTILITY

FIELD OF THE INVENTION

This invention relates to novelty products and specialty retail package containers for food that have a secondary utility.

BACKGROUND OF THE INVENTION

The present invention is a retail package for food in which a container is provided that is formed from curvilinear cross-sectioned mating components to form the shape of a sport ball. After the retail packaging function of the container is exhausted following purchase of the item, the separate mating components of the bisected container are useful as bowls for consumption of the packaged food and can be subsequently remated to form a separately useful object such as a coin bank.

Practically since the first televised sporting event, viewers have been placing bowls and containers of snack foods on tables near their television sets. While the magnitude and competitiveness and innovation of the snack food and televised sports industries are legend, the development of packaging and containers serving a combination of these industries has languished and has been relatively static. While they predate the television and sports marketing age, bowls are a principal snack food serving container for TV viewing. Bowls, however, have tended to be relatively pedestrian, decoratively as well as structurally. Footballs, basketballs, golf balls, soccer balls, base balls, tennis balls and other sports balls are well known and have shapes that are attractive to sports fans, but heretofore have not been used as containers of snack foods for sports fans.

SUMMARY AND OBJECTS OF THE INVENTION

The present invention is a container in the manner of an athletic ball suitable in a first incarnation as a retail package for the sale of a snack food and usable thereafter as a serving bowl, or a coin bank, lampshade or other purpose. The container has a point of sale attractiveness at retail, and is stable, useful and versatile in secondary functions after its retail function is exhausted after purchase.

Actual sport balls, such as footballs, golf balls, baseball and basketballs, are made from materials which are not suitable to contain food. It would be wasteful and cost prohibitive to make containers out of actual sports balls on a mass production scale. The present invention contains an accessible interior in a sports ball-shaped container with a relatively large permanent opening and a cover portion that is readily removable. In a replication of a curvilinear sectional sports ball means are provided for making the container sufficiently stable for use on table tops and for other utility after the initially packaged snack food is consumed.

According to the present invention, a container comprises a pair of relatively adjoining and generally bowl-shaped mating sections which are readily separable from one another. At least one of the mating sections has a relatively planar surface region occupying a minor portion of the surface area of the section that stabilizes that section on a table top. Preferably, the container is shaped like an athletic ball, is sized to hold a predetermined serving portion, such as, in the case of a full size replica of a football or basketball, several (3 or 4) ounces of popcorn or other snack food separately packaged, in a food grade approved bag made of cellophane, waxed paper, polymer wrap or the equivalent and also preferably includes on the surfaces graphic representations of features of an athletic ball on its outer surface and graphic representations of features of a playing field or arena and its environment, or sports activities therein on its inner surface.

Objects of the invention are to provide an attractive point of sale package in the form of a bisected container that is readily separable into two bowls which are stable on table tops. The invention appeals to those who enjoy eating snack foods while watching sports events or like to be reminded of sports otherwise. The container is useful for secondary purposes after service as a container for packaged foods.

Other objects and advantages are disclosed herein as the invention is more fully described with reference to the drawings in which:

DESCRIPTION OF THE PREFERRED EMBODIMENT

Figure 1:
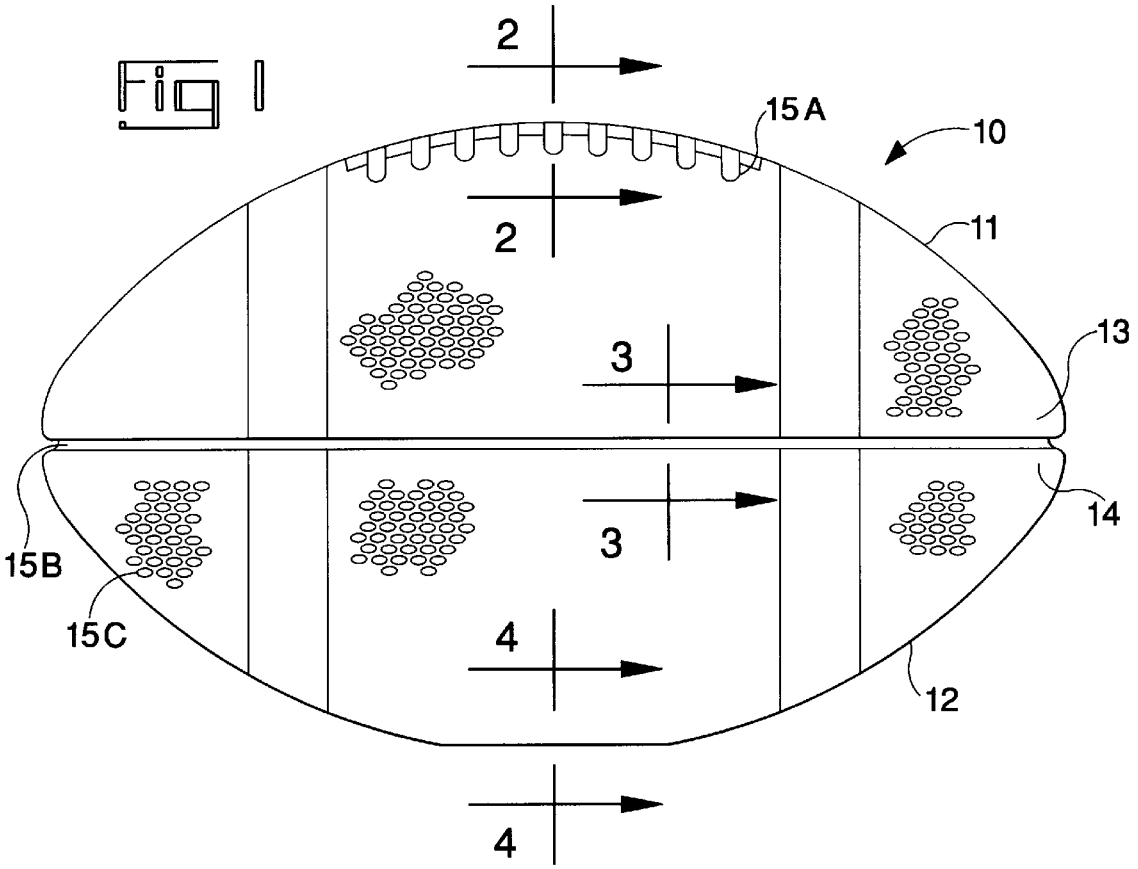
FIG. 1 is a side elevation view of a curvilinear cross-sectioned container according to the present invention.

As illustrated in FIG. 1, a curvilinear container according to the present invention and generally designated 10 is shaped like an American or Canadian style football. Alternatively, the subject container may be shaped like a spheroid collegiate or professional basketball or soccer ball or other sports ball such as a golf ball, tennis ball, bowling ball or base ball. The container is sized to contain for sale at retail a serving of food such as three or four ounces of popcorn, pretzels, peanuts, taco chips, potato chips, cheese puffs, bacon rinds, and their ready substitutes, or other snack food, mixed nuts, chocolates, candy, cookies and the like. A predetermined volume for a container determines its capacity and may affect the selection of a proper food with which the container is used. The subject container 10 is bisected and comprises two readily separable, upper and lower mating sections 11 and 12, respectively. Advantageously, relatively adjoining portions 13, 14 of the mating sections are disposed where a circumferential or equatorial seam is typically provided on an actual ball. In this manner, the football-like appearance of the container 10 is enhanced, and the mating sections 11, 12 are transformed into bowls of approximately equal size on separation of the sections. In addition, the upper/lower mating arrangement allows the force of gravity to assist in holding the upper section 11 in place on the lower section 12. A football may be sectioned in either axis. Graphic representations, such as of laces 15A, seams 15B, and surface dimpling 15C, are provided on exterior surfaces of the two sections 11, 12 to enhance the football-like appearance of the container 10.

Preferably, the container and each section 11 and 12 are formed from alloyed sheet metal, generally known as container "tinplate," a standard steel industry designation for container and can material. Tinplate is a thin sheet material comprised of a steel or a steel alloy coated to resist degradation and to allow printing thereon. The familiar supermarket "tin can" is formed from a material in this group. Graphic representations 15A–C are applied to the section surfaces in a manner known in the art. Other useful materials for forming the container include container grades of aluminum and its alloys, other malleable metals, blown, injection molded or formed polymers and co-polymers and blends, including polyethylene, polypropylene, acrylic and polystyrene materials conventionally used in forming containers of the sizes herein.

Figure 2:
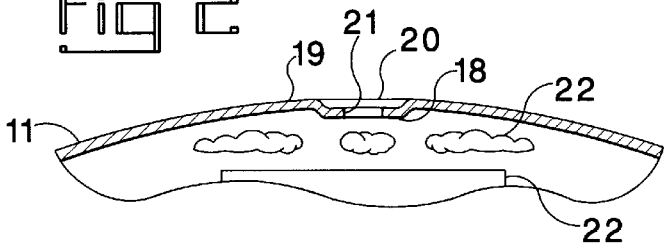
FIG. 2 is an enlarged fragmentary sectional view taken along line 2—2 of FIG. 1 and particularly illustrates a surface stabilizing exterior concavity in the form of a coin slot on one section of the container.

As illustrated in FIG. 2, a central depression or concavity 18 is formed in a crown portion 19 of the upper section 11. The central depression 18 is sized and positioned to define a flat perimeter edge portion 20 for engagement with a flat surfaced table top (not shown) when the upper section 11 is inverted and placed thereon. In this manner, the upper section 11 remains in a stable position when filled with snack foods or the like (not shown) or when the section is devoid of contents. Preferably, the depression 18 is formed with a slot 21. In this manner, the container 10, when the upper and lower sections are joined together, can serve as a receptacle for slips of paper such as tickets or stubs, money, job list items or other items that the user may collect. Preferably, graphic representations 22, such as of clouds and/or a scoreboard, are provided on the interior surface of the upper mating sections 11. The graphic representations on the interiors of the upper and lower sections may present a replication of a three dimensional, 360 degree panoramic view of an actual spectator seated in the venue at a live event. Thus, for example, a lower section may include a representation of a football field and stadium, with a perspective, for example, from a mid-section seat in the stadium, looking down, and the upper section may include a spectators view from the same seat looking above, and showing the stadium upper deck, scoreboard, a blimp flying above and clouds.

Figure 3:
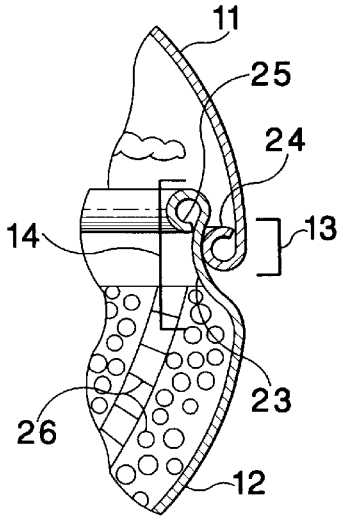
FIG. 3 is an enlarged fragmentary sectional view taken along line 3—3 of FIG. 1 and particularly illustrates the separable mating edge portions of the container sections.

As illustrated in FIG. 3, the relatively adjoining portions 13, 14 of the mating sections 11, 12 are disposed in overlapping or nesting relationship. Preferably, the adjoining portion 14 of the lower mating section 12 is inset relative to the adjoining portion 13 of the upper mating section 11 and defines a circumferential shoulder or ledge 23 upon which the upper mating section is seated. In addition, the free ends 24, 25 of the relatively adjoining portions 13, 14 are rolled inwardly upon themselves, thereby providing smooth surfaces for handling the mating sections 11, 12 and a slight friction fit therebetween.

Figure 4:
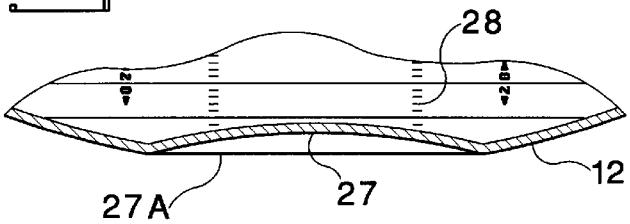
FIG. 4 is an enlarged fragmentary sectional view taken along line 4—4 of FIG. 1 and particularly illustrates a stabilizing exterior concavity on another section of the container.
Figure 5:
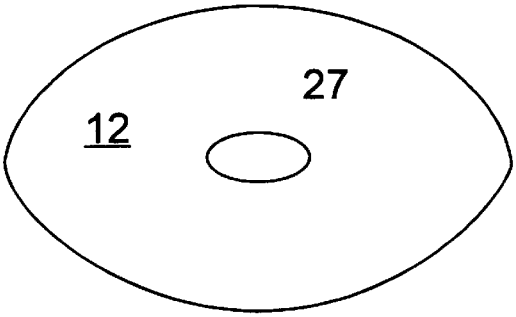
FIG. 5 and FIG. 6 are top views showing respectively a stabilizing concavity and coin slot on mating sections of a football shaped container shown in FIG. 1.
Figure 6:
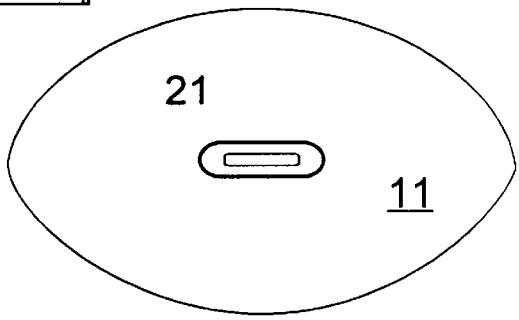

As illustrated in FIG. 4, a centrally located concave or planar region 27 is formed on the underside of the lower mating section 12. The region is defined by a two-dimensional shape, generally elliptical in the event of a football and circular in the event of a sphere. The shape defines a concavity or flat surface that stabilizes the lower section on a table or other surface. A perimeter portion 27A of the concavity 27 thereby provides a stable base when the lower mounting section 12 is placed on a table top (not shown) either with or without the upper mating section 11 mounted thereon. Preferably, the interior surface of the concave or planar region 27 and adjacent portions of the lower mating section 12 are include representations 28, such as of a playing field and of opposing football teams engaged in the sport as a spectator would view live action when physically present in the sport venue.

Figure 7:
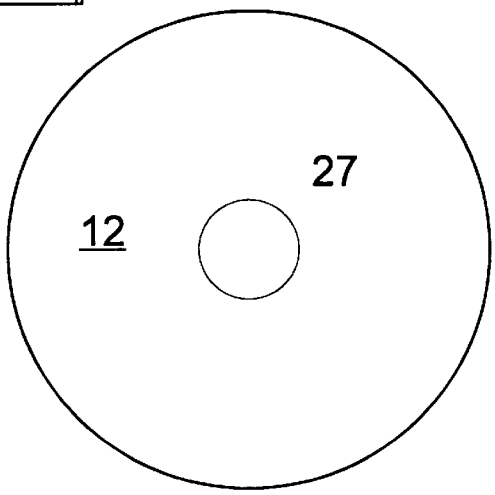
FIG. 7 and FIG. 8 are top views showing respectively a stabilizing concavity and coin slot on mating sections of a spheroid shaped container.
Figure 8:
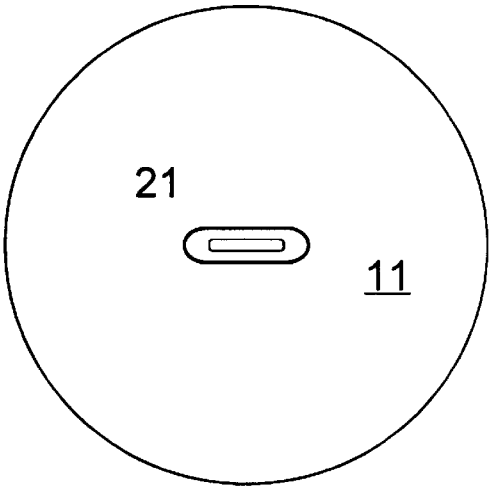
Figure 9:
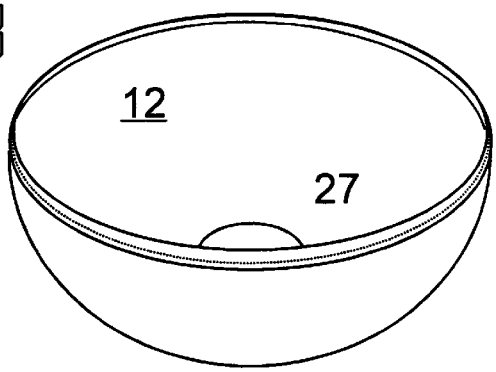
FIG. 9 shows a perspective view of the use of a section of the container as a bowl resting on the stabilizing section.

FIGS. 7, 8 and 9 show the bisectioned container in the shape of a spheroid that can be adapted to themes for sports using round balls with the same objects and elements as stated above, adapted to a particular sport.

In view of the foregoing disclosure, it may be understood that containers embodying the present invention are stable, attractive, versatile and appealing to those who enjoy consuming snack foods and being sports fans, and provides a secondary utility as a bowl, keepsake, coin or money bank, or collectible receptacle for other items once the container function of the original retail purchase is exhausted.

While a single preferred embodiment has been illustrated and described in some detail, the scope of the present invention, as defined in the claims set forth below, is not so narrowly confined.

What is claimed is:

1. A container comprising a pair of relatively adjoining and separable mating sections, each of said mating sections comprising an open mouth and a curved wall extending from the open mouth to define an essentially curvilinear receptacle, said open mouth being defined by a lip portion of the curved wall, said lip portion being defined by a portion of the curved wall rolled inwardly upon itself and comprising means for receiving the lip portion defining the open mouth of the other mating section, said container further comprising a substantially uninterrupted curvilinear inner surface on each of the mating sections, at least one of said mating sections having a discontinuity formed in at least an outer surface of the curved wall, said discontinuity having a substantially planar surface, and one of said mating sections having a slot for receiving coins extending through the inner surface and the outer surface of said mating section.

2. The container according to claim 1, wherein the discontinuity comprises a concavity in the outer surface of the curved wall.

3. The container according to claim 1, wherein a discontinuity is formed on each of said mating sections, and wherein the discontinuity on one mating section is disposed in surrounding relation to a coin-sized slot formed in the one mating section.

4. The container according to claim 1, wherein the mating sections are approximately equal in size.

5. The container according to claim 1, wherein said container is sized to hold a prepackaged serving portion of a snack food contained in a food grade bag formed of cellophane, waxed paper or polymeric wrap.

6. The container according to claim 1, wherein adjoining portions of the mating sections are disposed in a nesting relation in which the lip portion of one mating section overlaps the lip portion of the other mating section.

7. The container according to claim 1, wherein at least one of the mating sections is formed from a tinplate steel can material.

8. The container according to claim 1, wherein each of the mating sections is formed from a container grade of one of a group of malleable metals comprising tin, aluminum alloy, steel and copper alloy.

9. The container according to claim 1, wherein at least one of the mating sections is formed from a polymer, co-polymer or blend of polymers.

10. The container according to claim 9, wherein the polymer, co-polymer or blend material includes one of the group of blown, injected or formed polyethylene, polypropylene, acrylic and polystyrene materials.

11. The container according to claim 1, wherein a first layer of graphic material is disposed on the outer surface of each of the mating sections, said first layer of graphic material comprising a representation of a surface texture of a regulation athletic ball selected from the group comprising a football, a basketball, a soccer ball, a tennis ball, a baseball, a softball, a volleyball, and a golf ball.

12. The container according to claim 11, wherein a second layer of graphic material is disposed on the inner surface of at least one of the mating sections, said second layer of graphic material comprising a panoramic representation of a plurality of spectators.

13. A retail package comprising a pair of relatively adjoining and separable mating sections, each of said mating sections comprising an open mouth and a curved wall extending from the open mouth to define an essentially curvilinear receptacle, said open mouth being defined by a lip portion of the curved wall, said lip portion being defined by a portion of the curved wall rolled inwardly upon itself and comprising means for receiving the lip portion defining the open mouth of the other mating section, said container further comprising a substantially uninterrupted curvilinear inner surface on each of the mating sections, at least one of said mating sections having a discontinuity formed in at least an outer surface of the curved wall, said discontinuity having a substantially planar surface, and one of said mating sections having a slot for receiving coins extending through the inner surface and the outer surface of said mating section.

14. A retail package according to claim 13, wherein a discontinuity is formed on each of said mating sections, and wherein the discontinuity on one mating section is disposed in surrounding relation to a coin-sized slot formed in the one mating section.

15. The retail package according to claim 13, wherein the discontinuity comprises a concavity in the outer surface of the curved wall.

16. The retail package according to claim 13, wherein the mating sections are formed from a container grade of one of the group of malleable metals comprising tin, aluminum alloy, steel, and copper alloy.

17. The container according to claim 13, wherein a first layer of graphic material is disposed on the outer surface of each of the mating sections, said first layer of graphic material comprising a representation of a surface texture of a regulation athletic ball selected from the group comprising a football, a basketball, a soccer ball, a tennis ball, a baseball, a softball, a volleyball, and a golf ball.

18. The container according to claim 17, wherein a second layer of graphic material is disposed on the inner surface of at least one of the mating sections, said second layer of graphic material comprising a panoramic representation of a plurality of spectators.

* * * * *